US007350666B2

(12) United States Patent
Essebaggers

(10) Patent No.: US 7,350,666 B2
(45) Date of Patent: Apr. 1, 2008

(54) SELF REGULATING SPOUT

(76) Inventor: Jan Essebaggers, Burg. Vogelaarsingel 11, Nieuwerkerk ad IJsse (NL) 2912 BB ( * ) Notice: Subject to any disclaimer, the term of this patent is extended or adjusted under 35 U.S.C. 154(b) by 0 days.

(21) Appl. No.: 10/199,812

(22) Filed: Jul. 22, 2002

(65) Prior Publication Data

US 2004/0011800 A1 Jan. 22, 2004

(51) Int. Cl.
*A47G 19/22* (2006.01)
*B67D 3/00* (2006.01)

(52) U.S. Cl. ..... 220/714; 220/717; 222/514

(58) Field of Classification Search ..... 222/514, 222/518; 215/11.4, 11.5, 229, 387, 388; 220/203.03, 203.04, 203.09, 203.1, 203.11, 220/203.12, 203.19, 203.23, 203.27, 203.29, 220/705–707, 711, 713, 714, 716, 717, 719; 137/510, 907

See application file for complete search history.

(56) References Cited

U.S. PATENT DOCUMENTS

| | | | | |
|---|---|---|---|---|
| 3,190,508 | A * | 6/1965 | Petersen | 222/402.2 |
| 4,796,774 | A | 1/1989 | Nabinger | 220/90 |
| 4,852,776 | A | 8/1989 | Patton | 222/570 |
| 4,883,192 | A | 11/1989 | Krugman | 220/85 |
| 5,071,042 | A | 12/1991 | Esposito | 222/570 |
| 5,079,013 | A * | 1/1992 | Belanger | 426/115 |
| 5,186,347 | A | 2/1993 | Freeman et al. | 220/254 |
| 5,542,670 | A | 8/1996 | Morano | 220/714 |
| 5,947,324 | A | 9/1999 | Palinchak | 220/713 |
| 6,062,419 | A * | 5/2000 | Kruger et al. | 220/711 |
| 6,290,090 | B1 * | 9/2001 | Essebaggers | 220/710 |
| 6,305,570 | B1 * | 10/2001 | Atkin et al. | 220/714 |
| 6,523,711 | B1 * | 2/2003 | Hughes et al. | 220/709 |
| 6,629,624 | B2 * | 10/2003 | Stillinger et al. | 220/714 |
| 7,089,953 | B2 * | 8/2006 | Beau | 137/102 |

FOREIGN PATENT DOCUMENTS

| | | | |
|---|---|---|---|
| DE | 100 16 053 | A1 * | 10/2001 |
| GB | 2169210 | A * | 7/1983 |
| WO | WO 01/12338 | A1 * | 2/2001 |
| WO | WO 01/92133 | A2 * | 12/2001 |

* cited by examiner

*Primary Examiner*—Robin A. Hylton
(74) *Attorney, Agent, or Firm*—Oliff & Berridge, PLC

(57) ABSTRACT

A drinking spout for beverage cans, bottles, cups or hand-held containers that temporarily hold a drinking fluid (beverage), which can be carbonated or a hot drink under pressure and which is closed off by the spout. Spilling of the fluid held therein is prevented during awkward drinking situations such as in cars while driving, walking or other less controlled drinking conditions. The fluid in the container, remains under pressure while permanent access is possible through the spout. The spout comprises a suction piece that is leak tight attached to a valve housing which holds a spring, a centrally perforated inverted membrane and a valve. When suction is applied to the spout, the inverted membrane moves downwards thereby opening the valve against the internal pressure of the bottle or container and allowing fluid to pass to the mouth. When the suction stops, a spring closes the valve. Air venting is provided, through the same valve, when the internal gas pressure drops below the atmospheric pressure.

15 Claims, 5 Drawing Sheets

SELF REGULATING SPOUT

FIELD OF THE INVENTION

The invention is used as a means to empty by mouth beverage cans, bottles or drinking cups with cover, or other hand held containers, used for storing temporarily a carbonized or non-carbonized drinking fluid. The invention enables the extraction of the fluid without spilling, while in action and fluid is withdrawn from the handheld container or when the container is overturned. U.S. class 220/706; 220/85; 222/214; 220/713; 220/714 etc. (International Patent Classification A47G19/22; BD65d 1/00; BD65D 25/48 etc.) This patent is an improvement over a former patent published under U.S. Pat. No. 6,290,090 as referenced in the "Information Disclosure Statement" (IDS) to this application, thereby providing a new inventive disclosure, not foreseen in U.S. Pat. No. 6,290,090.

OBJECT OF THE INVENTION

Carbonated beverages are supplied in aluminum cans, bottles or other containers for consumption. As soon as the can or bottle is opened, the fluid starts deteriorating and becomes flat in short time thereafter. If supplied in family bottles, the beverage is normally poured into a cup for immediate drinking, while the rest is kept under pressure in the bottle for future use by using a screw cap. Aluminum cans, however, are commonly opened by pulling away a piece of the top closure and cannot be closed thereafter. This means that the fluid needs to be consumed more or less immediately after opening. Also when poured from a bottle into a cup the amount may be too much for immediate consumption and someone may want to use it over an extended period of time.

Cups were invented that could hold a beverage without spilling when the cup was overturned. These so called non-spilling cups were not suited, however, for carbonized beverages. In prior art solutions it became apparent that no pressure can be maintained in these non-spilling cups or handheld containers and do not prevent spilling of fluid, while in action or when overturned.

The object of the invention is thus maintaining the beverage carbonized in a container that is in use, while access to the fluid is easy and spilling is prevented when in motion and at all positions of the container. The same applies for hot drinking fluids, thereby keeping the fluid inside the cup or container when overturned, while the air pressure rises due to expansion of the enclosed air.

BACKGROUND OF THE INVENTION

Drinking cups and handheld containers with leak tight top-covers, combined with drip-less spout and air vent are provided throughout the years in many shapes and forms, in order to prevent spilling of the liquid, contained therein for temporarily storage. The spout and vent are provided with valves that enable fluid to be withdrawn from the container or cup, when someone sucks on the spout. The reduction in fluid content in the container is replaced by air that flows through a second opening in the cover. This air vent holds a valve that opens when the pressure drops below the atmospheric outside pressure, due to the suction action at the spout. As an example; a drip less feeding/training container of this nature has been described by Belanger in U.S. patent description U.S. Pat. No. 5,079,013; U.S. Pat. No. 5,542,670 by Morano; U.S. Pat. No. 5,186,347 by Freeman etc. For all these inventions the application was primarily made for babies and toddlers with the objective of eliminating spillage of the fluid by overturning the cup or container and while drinking during movement. In the above patent descriptions other references are made to other inventors, all with the same or similar goals in mind of eliminating spillage of fluid.

The thus described applications are suitable for non-carbonized fluids and cold drinks only. If carbonized fluids are used, the pressure in the container will built-up thereby pushing the valve open and leakage and spilling is not prevented. The same applies to hot drinking fluids, whereby the air above the fluid is heated and expands, causing the pressure in the container to rise thereby causing the fluid to move out, if not held in the upright position. Spilling could be prevented, however, by using a stronger resilient valve material in the case of Morano U.S. Pat. No. 5,542,670 or a stronger spring in the case of Belanger, U.S. Pat. No. 5,079,013. The draw back, however, is that suction on the spout has to increase appreciably, even beyond human capacity while opening of the valve would become impossible or at least cumbersome.

For beverage cans, as nowadays are commonly available to the consumer with carbonized drinking fluids, adapters are provided that clips onto the top of the can to close off the beverage can after opening and/or make drinking easier than directly from the can. Such features are provide for in the following patent descriptions: U.S. Pat. No. 4,796,774 by Nabinger; U.S. Pat. No. 4,852,776 by Patton; U.S. Pat. No. 4,883,192 by Krugman; U.S. Pat. No. 5,071,042 by Esposito, U.S. Pat. No. 5,947,324 by Palinchak, EP 0870 685 A1 by Igor etc. These applications have the disadvantage that the pressure is immediately released from the can after opening and in the shortest possible time the carbon dioxide is released from the fluid and becomes flat and much less attractive to drink. This means that all previous described applications are not suitable for carbonized beverages or hot drinking fluids. A major improvement to the above problems has been provided in U.S. Pat. No. 6,290,090 of Essebaggers, whereby a valve that closes off the drinking fluid, is opened by a membrane. This membrane enables the valve to be closed by a much stronger spring (or the resilient force of the membrane itself) than in earlier solutions, as the surface area on which the suction pressure operates to open the valve, has been substantially increased. The allowable pressure in the container can be increased appreciably over the previous solutions, before leakage occurs. The magnitude of the allowable pressure in the container, however, has a direct relation with the stiffness of the spring and subsequently the surface area of the membrane. This means that with a certain diameter (surface area) of this membrane there is a limit to the stiffness of the spring that keeps the valve closed and at the same time to enable a human to suck the valve open.

The present invention overcomes the latter problem by inverting the membrane, which now pushes the valve open rather than pulling, thereby combining a number of advantages over prior art solutions. This means that the spring stiffness has no relation with the internal gas pressure of the container and for that matter a very weak spring can be used, just adequate to pull the valve closed. If the gas pressure increases, the valve will be pushed onto its seat by the internal gas pressure instead of being opened as for the earlier solution as described in patent U.S. Pat. No. 6,290,090 of Essebaggers. This means that as long as the internal gas pressure is higher than atmospheric, the valve will be forced closed, while when the internal pressure drops below the atmospheric pressure (by emptying the container), air can enter through the same valve thereby reducing the vacuum and making fluid extraction more easy.

BRIEF SUMMARY OF THE INVENTION

The present invention of one type of embodiment, comprises a spout system of various parts for sucking fluid from a bottle, metal beverage can, cup closed with a cover or other handheld container, whereby the fluid can be a carbonized beverage or hot drink such as coffee or tea. The Self Regulating Spout (further called SRS) being the object of the present invention, is activated by sucking on the spout, whereby an inverted membrane type element pushes a valve open, that closes off the inside of the container from the outside. The inside of the container normally has a higher gas pressure than the atmospheric outside pressure caused by the carbonized fluid or expanding air that is heated by a hot drinking fluid within the confinement of the drinking cup or container. The SRS comprises a spout, gas tight connected to a valve housing, a spring, a centrally perforated inverted membrane having a tubular extrusion that enables the fluid to flow from the container to the spout through the tubular opening in the inverted membrane, a valve housing with valve seat and a valve of soft resilient material. The valve is held in the closed position by a spring that pulls the valve closed. By reducing the pressure on the lower side of the inverted membrane by sucking on the spout, the inverted membrane will move downwards thereby displacing the valve and opening up the inside of the container allowing fluid to flow. The fluid flows from the container through a thin flexible tube in the shape of a straw inside the container, that reaches from the bottom of the container to the valve opening, through the tubular part of the inverted membrane through the spout into the mouth. The valve closing area is substantially smaller than the active surface area of the inverted membrane. A small suction pressure difference over the inverted membrane will result in a relative large force to open the valve against the pressure of the spring, that keeps the valve closed and the internal pressure of the container. The interaction between the valve, and inverted membrane is therefore essential in enabling the SRS to work. The valve housing of the SRS is either a gas tight fit in a hole in the cover of an aluminum beverage can, screwed onto a bottle neck or is an integral part of a gas tight cover of a drinking cup. The upper side of the inverted membrane is held at atmospheric pressure by an opening in the spout of the SRS. When the pressure in the can, bottle or cup drops below atmospheric pressure by the reducing fluid level, the valve opens automatically against the spring pressure, as soon as the suction action is momentarily stopped. For this reason the spring stiffness should be relative weak in order to open the valve with a small pressure difference over the valve when a vacuum becomes present in the container. By so described, the SRS closes off the inside of the handheld container from the outside under all circumstances and position of the container, when not in use for drinking, but opens automatically when someone sucks on the spout for fluid withdrawal.

BRIEF DESCRIPTION OF THE DRAWINGS

The following accompanying drawings of two preferred embodiments will clarify the features of the present invention (SRS) to those skilled in the art of reading the drawings and accompanying specification.

DETAILED DESCRIPTION OF THE INVENTION

Figure 1:
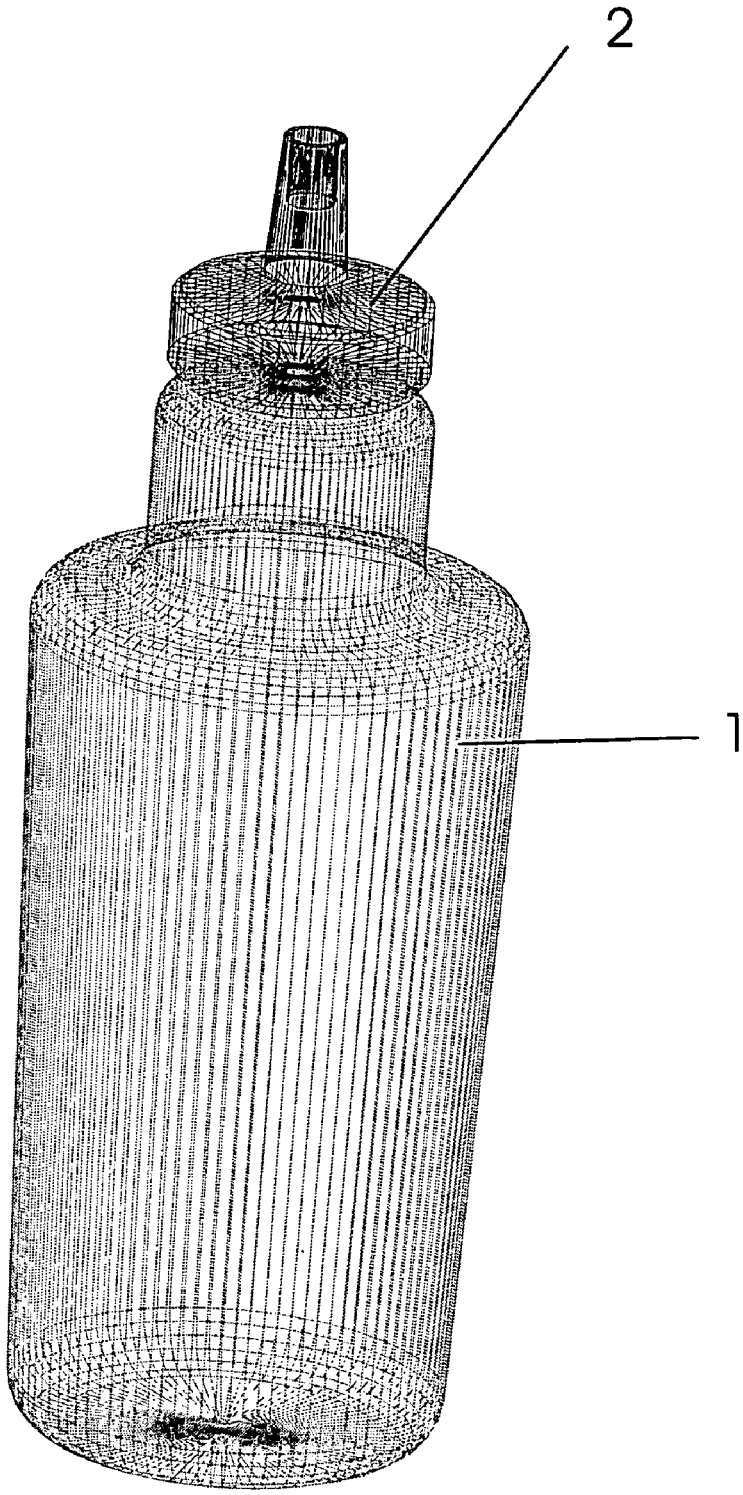
FIG. 1 is an outside perspective view of an assembled beverage bottle or container, that embodies one of the preferred embodiment of the present invention.
Figure 2:
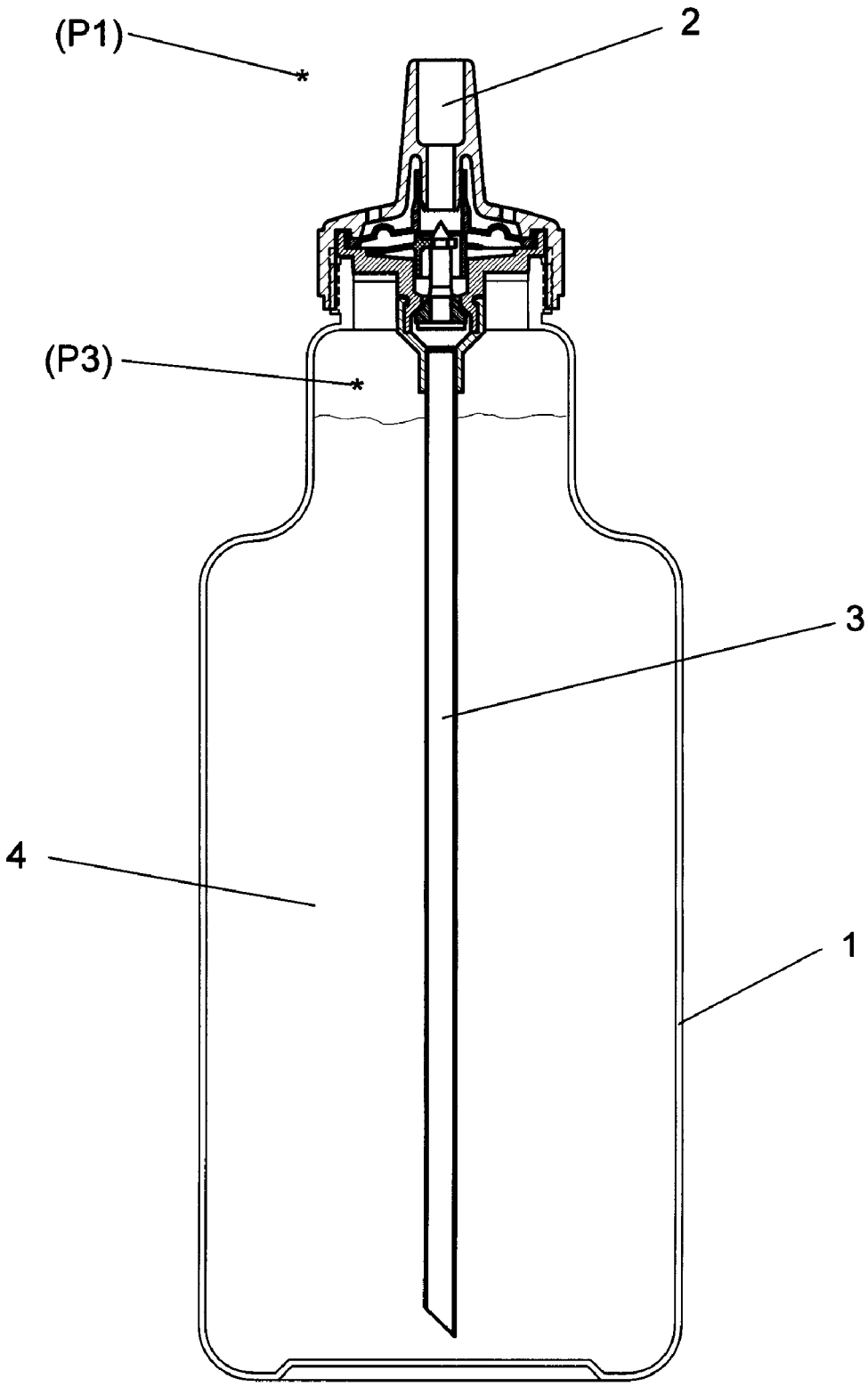
FIG. 2 is a longitudinal cross-sectional view of an assembled beverage container of the first embodiment of the invention of which further details are shown in FIGS. 3 and 4.
Figure 4:
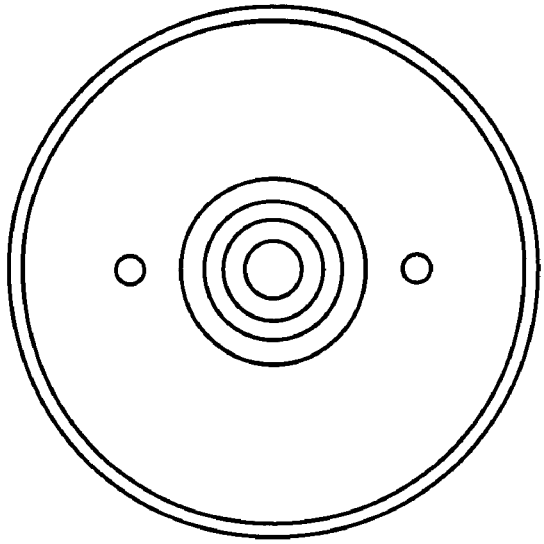
FIGS. 3 and 4 is a cross-sectional view and a top view respectively of the first preferred embodiment showing all parts required for the SRS of the present invention which includes a (blade) spring, for closing the valve. Details of the various parts of the SRS are shown in FIGS. 3*a* through 3*i*
Figure 3:
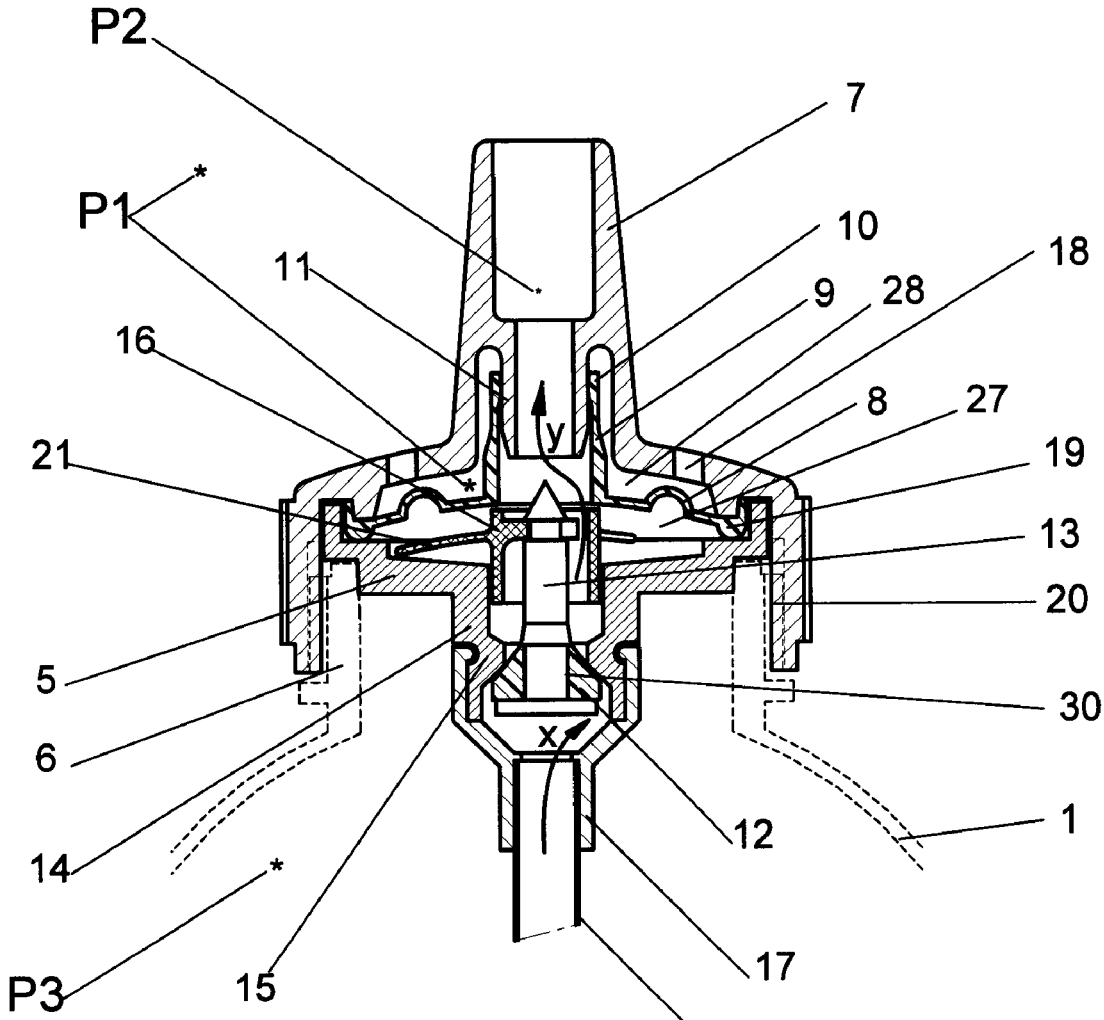
Figure 3A:
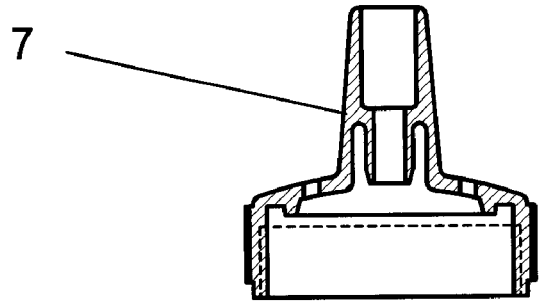
Figure 3B:
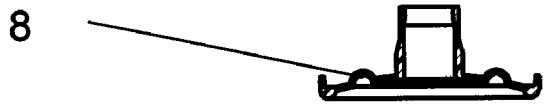
Figure 3C:
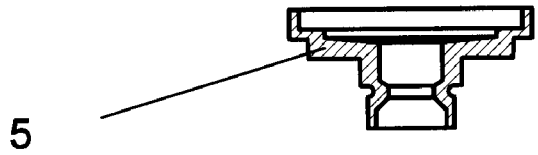
Figure 3D:
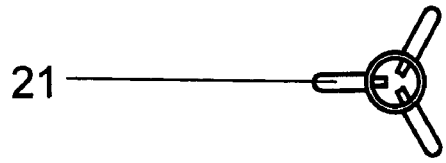
Figure 3E:
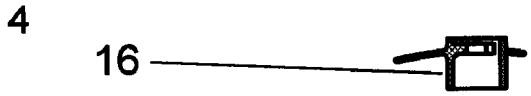
Figure 3F:
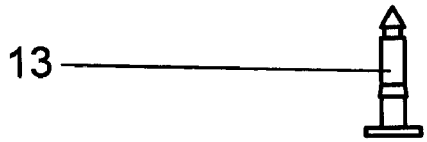
Figure 3G:
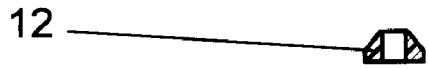
Figure 3H:
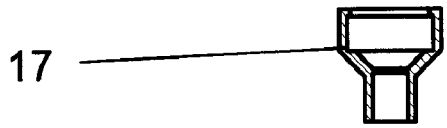
Figure 3I:
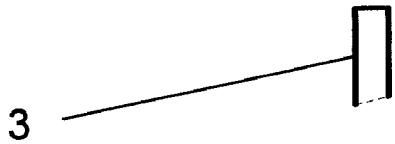

With reference to the drawings, the invention will be described for application with a disposable and a non-disposable bottle or handheld fluid container, commonly available on the market for consumption of soft drinks, water etc. but as here described for carbonized beverages and hot drinks. In this description the abbreviation "SRS" (Self Regulating Spout) is used, subject of this invention and which comprises a plurality of parts, described later on in this section. FIG. 1 shows a perspective view of a bottle 1 with an SRS 2 fixed at the top, of the first preferred embodiment. Details of this embodiment are shown in a longitudinal cross-sectional view of FIG. 2. This figure shows a cross-section of the bottle 1, a cross-section of the SRS 2 having an internal straw or flexible tube 3, that enables to suck the fluid 4 from the bottle or container in an upright position, without the need of bending the head backwards. The bottle 1, at the top closed off with an SRS 2, holds a carbonized beverage 4 which is maintained at an internal gas pressure (P3) by the carbonization process. This gas pressure can be substantially higher than the outside atmospheric pressure (P1) to keep the beverage carbonized for the pleasure of drinking the fluid. The SRS 2 maintains this gas pressure for as long as needed, while access to the fluid remains possible without the need of opening the bottle. The working of the present invention (SRS) is further described by looking at FIGS. 3 and 4 showing a cross-sectional view and a top view of the SRS respectively and a part of the bottle or fluid container. The fluid in bottle 1 (or container), held at an internal gas pressure (P3) is closed off at the top by a valve housing 5 that fits tightly into the bottle neck 6 of bottle 1 and forms part of the barrier between the inside and outside. This valve housing is held in place by a spout 7 that is screwed onto the bottle neck 6 by means of a screw thread connection 20.

A space is formed between spout 7 and the valve housing 5 in which an inverted membrane 8 is located that divides this space in two compartments 27 and 28, which compartments are normally at the same atmospheric pressure P1, but when someone sucks on spout 7 the pressure under the inverted membrane drops to a value P2 (suction pressure) creating a pressure difference between compartment 28 and 27 with a value (P1-P2). This pressure difference is maintained by a fixed integral seal 19 on the periphery of the inverted membrane 8 and a sliding seal 10 between an inner extruded tubular part or spigot 11 of spout 7 and an extruded tubular part 9 of inverted membrane 8. This inverted membrane, with seal 19, is clamped on its periphery airtight to the valve housing 5, by means of the screw thread connection 20 between spout 7 and the bottle neck 6 of bottle 1. Above and below the inverted membrane, adequate space is provided to allow the inverted membrane to move a few millimeters up and down at the center area, while fixed at the periphery. The inverted membrane 8 is integrally connected to an extruded tube 9, which fits with a sliding seal connection 10 airtight over an internal extruded tube or spigot 11, being a part of spout 7. Valve 12 is held in place by a valve stem 13 that fits within the lower cylindrical part 14 of valve housing 5 having a valve seat 15. The valve 12, which is gas tight connected to valve stem 13 at location 30, is held closed by a blade spring 16 having three or more blades 21, when no suction is applied to the spout. The valve 12, is of resilient material, that fits tightly into the valve seat 15, preventing gas or fluid to pass when closed. In order to enable emptying the bottle in its upright position, a flexible tube (straw) 3 is used, that is leak tight connected to the extruded cylinder 14 of the valve housing 5 via a straw-holder 17 and reaches down to the bottom of the bottle or fluid container 1. Blade spring 16 pulls the valve assembly 12 and 13 to its rest position, thereby keeping the bottle shut. When the pressure P2 under the inverted membrane 8 is reduced by sucking on spout 7 valve 12 is pushed from its seat 15. A small air passage 18 is provided in the spout 7 to assure that the back pressure on the upper side of the inverted membrane remains atmospheric (P1).

The SRS 2 is thus activated: Suction by mouth on spout 7 will move the inverted membrane 8 downwards, thereby pushing the valve 12 from its seat 15 against the internal gas pressure (P3) and the closing pressure of the (blade) spring 16. The magnitude of the force to activate the valve can be determined from the pressure difference over the inverted membrane times the active surface area of the inverted membrane, which is (P1-P2)×A. The active surface area "A" being $\frac{1}{4}.\pi.d^2$ in which "π" (pi) is 3.14 and "d" is the active diameter of the inverted membrane. When the valve is pushed from its seat, the fluid in the bottle will be forced outwards by the pressure difference P3-P2, which is respectively the gas pressure in the bottle and the suction pressure in the spout. This means that when someone sucks on the spout, the fluid flows through the flexible tube (straw) 3 through straw holder 17, passes the valve 12, through the hollow extruded tube 9 as part of the inverted membrane 8 to the spout 7 and into the mouth. This flow through the SRS is represented in the drawing (FIG. 3) by arrow x and y. As soon as the suction action stops, the pressure difference (P1-P2) ceases, leaving only the blade spring 16 to pull the valve 12 back onto its seat 15 and thus closes off the fluid passage. If the internal pressure P3 is higher than the atmospheric pressure P1, the pressure difference (P3-P1) will also act on the valve and pushing it closed.

Under certain circumstances it is possible that by emptying the bottle, the internal pressure P3 is substantially reduced and even becomes less than the atmospheric outside pressure P1. In that case the suction pressure by mouth will still be able to open the valve, but may not be sufficient to empty the bottle completely. This is remedied by stopping the suction action momentarily thereby allowing air to enter into the bottle through the same valve 12, which will automatically open by the pressure difference (P1-P3) over the valve. This feature assures that the inside pressure P3 of the bottle or fluid container will never drop substantially below the atmospheric outside pressure P1.

In FIGS. 3-*a* through 3-*i* (in which FIG. 3-*d* is a top view of blade spring FIG. 3-*e*) the individual parts are drawn that makes up the SRS as described above of the first preferred embodiment. This first embodiment of the SRS, which can be disassembled for cleaning, is not meant to limit the invention to other configurations or be only used for carbonized beverages. Other configurations are conceivable, whereby the same principle of force enlargement is applied by using an inverted perforated membrane that activates a valve, against the inside pressure of the bottle or fluid container.

Figure 6:
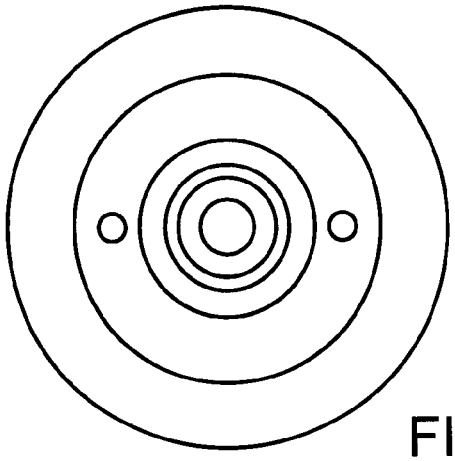
FIGS. 5 and 6 shows a cross-section and top view respectively of a second embodiment, whereby the (blade) spring has been eliminated, thereby simplifying the design of the SRS for use with disposable bottles.
Figure 5:
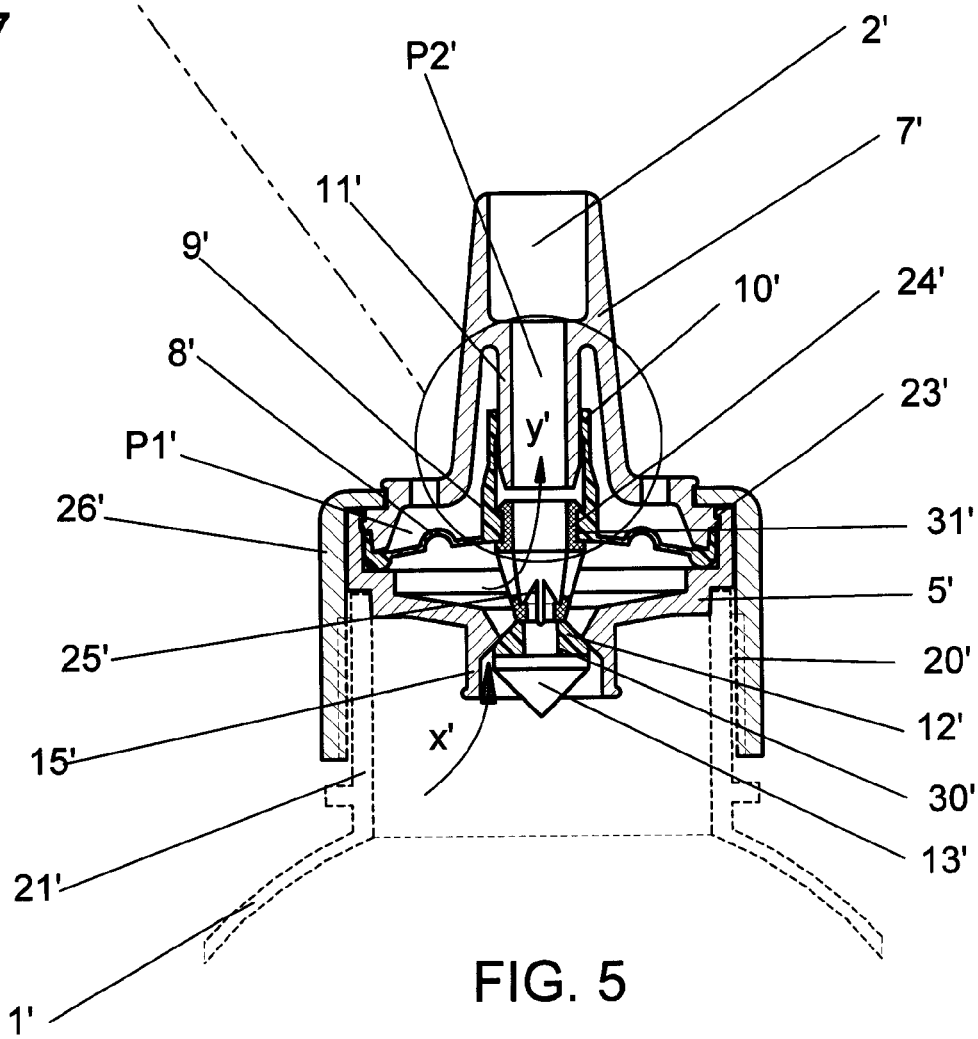

In FIGS. 5 and 6 a second preferred embodiment is shown, depicting a longitudinal cross section and a top view of the SRS respectively for use with a disposable bottle, whereby the SRS is assembled in such away that it cannot be taken apart for cleaning and is for one time use only, hereafter further identified as SRS 2'. As the principle of operation of the SRS 2' for this application, is exactly the same as described for the first preferred embodiment, this part will not be repeated and only the differences will be described. In this case the valve housing 5' is leak tight connected to spout 7', by a snap on connection 23' in such away that when assembled it cannot be taken apart. In addition the valve 12' with the valve stem 13' is directly connected to the inverted membrane 8', through a valve connecting piece 24', which is hollow in nature thereby allowing fluid to pass through, as shown by the arrow y' in FIG. 5. The flow represented by arrow x' and y' can only exist when the valve 12' is pushed open by the inverted membrane 8' as a result of the suction force over the inverted membrane caused by the pressure difference (P1'-P2'). (Note: The valve as shown on FIG. 5 is in its closed position). The valve stem 13' holding valve 12', made of a resilient material, is connected to the valve connection piece 24' by another snap on connection 25'. The valve 12' is thereby tightly connected to the valve stem 13' at location 30' in such away that no fluid or gas can pass. The inverted membrane 8' is constructed of a resilient material in such away, that it can move up and down at its center when there is a pressure difference over the inverted membrane, but at the same time will also act as a spring, thereby keeping the valve in its close position, when the SRS 2' is not in use. The valve connection piece 24' is tightly connected to the inverted membrane 8' at location 31' by the elasticity of the material of the inverted membrane and hard material of the valve connection piece 24'.

The second preferred embodiment of the SRS of FIG. 5 works as follows: When someone sucks on spout 7', the inverted membrane will move downwards, thereby pushing valve 12' open. When the bottle 1' is held upside down the liquid from the bottle is then allowed to pass to the mouth through the open valve 12', the valve connection piece 24' through the tubular part 9' of the inverted membrane 8' and spout 7' into the mouth. The flow in the drawing (FIG. 5) is represented by the arrows x' and y'. When suction stops, the inverted membrane moves back to its rest position, thereby pulling the valve 12' closed and no fluid or gas is allowed to pass to the outside.

The SRS 2' assembly, being a second embodiment of the invention, comprising a spout 7' and a valve housing 5' in which the inverted membrane 8' and valve assembly 12', 13' and 24' are held, is gas tight connected with a screw cap 26' to the bottle neck 21' of bottle 1' by means of a screw thread connection 20'.

The prime difference between the two described embodiments of the invention is that the separate blade spring 16 of FIG. 3 for closing the valve has been eliminated and that the valve thereby is closed by the inverted membrane itself, as depicted in FIG. 5.

Figure 7:
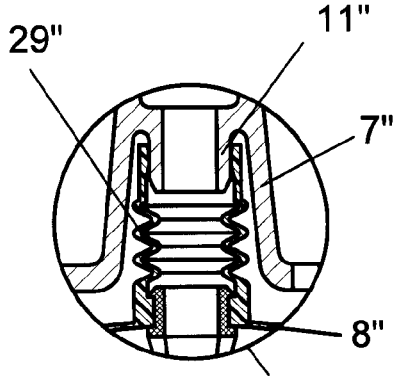
FIG. 7 showing a cross sectional view of a bellows, that is an alternative to the sliding seal between the inverted membrane and the spout of FIGS. 3 and 5.

The thus described embodiments require a gas tight sliding seal between the extruded tube 9 (9') of the inverted membrane 8 (8') with a seal 10 (10') sliding over the extruded inner tube/(spigot) 11 (11') within the spout 7 (7') and thus forming a siding seal. Air leakage at this location could cause the SRS to malfunction. This, however, will never result in a leakage of the fluid or gas from the bottle or container to the outside. A solution could be to use a bellows 29" between the inverted membrane 8" and the extruded tube/(spigot) 11" of spout 7" as shown in FIG. 7, as an alternative to the sliding seal. Also a so called O-ring may be applicable to create a sliding seal at this location, but this might prove to be cumbersome and is not further described.

The above description of the invention (SRS) represents two embodiments, used for accessing beverages in a bottle or closed handheld container. Other applications are thinkable in industrial processes, whereby a limited amount of fluid is withdrawn from a container by applying a vacuum on a centrally perforated inverted membrane system, as described above.

What I claim as my invention is:

1. A spout assembly for connecting to an opening of a container to empty a fluid from the container, which fluid may be under a gas pressure, the spout assembly comprising:

a spout that includes (i) a mouthpiece through which fluid can pass and (ii) a tube, the tube being in fluid communication with the mouthpiece so that fluid can pass through the tube and the mouthpiece;

a valve assembly including (i) a valve housing including a valve seat and (ii) a valve that is resiliently urged against the valve seat by an urging force;

a membrane device that includes (i) a membrane device opening and (ii) a fixed seal that seals between the spout and the valve housing; and a seal structure that maintains a seal between the membrane device opening and the tube;

said membrane device flexing toward an interior of the container when suction is applied to the tube via the mouthpiece, and forcing the valve away from the valve seat in opposition to the urging force.

2. The spout assembly of claim 1, further comprising a spring that applies the urging force.

3. The spout assembly of claim 1, wherein the membrane device applies the urging force.

4. The spout assembly of claim 1, wherein an air passage is formed in the spout, the air passage promoting retention of atmospheric pressure between the spout and a side of the membrane device that faces away from the interior of the container.

5. The spout assembly of claim 1, wherein the membrane has an undulating shape in cross section and is of a resilient material.

6. The spout assembly of claim 1, wherein a surface area of the membrane device on which the suction acts is substantially larger than a surface area of the valve on which inside gas pressure of the container acts.

7. The spout assembly of claim 1, wherein the seal structure comprises a seal tube that extends from the membrane device and slidingly seals against the tube of the spout.

8. The spout assembly of claim 1, wherein the seal structure comprises a bellows between the tube and the membrane device opening.

9. A combination, comprising:

a container that has an opening; and the spout assembly of claim 1, attached to the container and covering the opening of the container.

10. The combination of claim 9, wherein the container is made of metal or plastic material that can hold a fluid under gas pressure or at elevated temperature.

11. The combination of claim 9, further comprising a fluid contained within the container.

12. The combination of claim 11, wherein the fluid is under gas pressure.

13. The combination of claim 11, wherein the fluid is a beverage.

14. The combination of claim 9, wherein the container includes a first screw thread surrounding the opening of the container, and the spout assembly includes a second screw thread that engages with the first screw thread.

15. The combination of claim 9, wherein the spout assembly is permanently pressed on the opening of the container.

* * * * *